US006966292B2

(12) United States Patent
Huang

(10) Patent No.: US 6,966,292 B2
(45) Date of Patent: Nov. 22, 2005

(54) AIR INTAKE PIPE ABLE TO INCREASE INTAKE OF AIR AND BENDABLE FREELY FOR ASSEMBLY

(76) Inventor: Ruey-Fa Huang, No. 523, Jhanglu Rd., Sioushuei Township, Changhua County 504 (TW)

( * ) Notice: Subject to any disclaimer, the term of this patent is extended or adjusted under 35 U.S.C. 154(b) by 0 days.

(21) Appl. No.: 10/790,843

(22) Filed: Mar. 3, 2004

(65) Prior Publication Data

US 2005/0092278 A1 May 5, 2005

(30) Foreign Application Priority Data

Oct. 31, 2003 (TW) ..... 92219418 U

(51) Int. Cl.[7] ..... F02M 35/10
(52) U.S. Cl. ..... 123/184.21; 285/148.23
(58) Field of Search ..... 123/184.21, 184, 123/56, 184.55, 184.53; 285/93, 148.23, 285/231

(56) References Cited

U.S. PATENT DOCUMENTS 4,800,985 A * 1/1989 Hanzawa et al. ..... 181/229
5,143,408 A * 9/1992 Holtsmark ..... 285/93
5,769,045 A * 6/1998 Edwards et al. ..... 123/184.61

* cited by examiner

*Primary Examiner*—Henry C. Yuen
*Assistant Examiner*—Hyder Ali
(74) *Attorney, Agent, or Firm*—Troxell Law Office, PLLC

(57) ABSTRACT

An air intake pipe able to increase intake of air and bendable freely for assembly includes an accelerating inner pipe, an air intake outer pipe and a flexible fit pipe. The accelerating inner pipe has one end connected with the air intake end of an engine, and the air intake outer pipe has one end connected with an air filter. The accelerating inner pipe and the air intake outer pipe respectively have the other end movably fitted with the flexible fit pipe. The diameter between the air intake outer pipe and the accelerating inner pipe is shrunk to increase the intake and pressure of air. The rotatable fit structure between the flexible fit pipe and the accelerating inner pipe and the air intake out pipe, and the flexibility of the flexible fit pipe enable the air intake pipe to be installed in various engine rooms of different automobiles.

4 Claims, 8 Drawing Sheets

AIR INTAKE PIPE ABLE TO INCREASE INTAKE OF AIR AND BENDABLE FREELY FOR ASSEMBLY

BACKGROUND OF THE INVENTION

1. Field of the Invention

This invention relates to an air intake pipe, particularly to one having its opposite ends respectively connected between the air intake end of the engine of an automobile and an air filter, able to increase intake of air and bendable freely to be assembled.

2. Description of the Prior Art

Generally, the engine of an automobile is provided with an air inlet to suck in air for combustion or mixture vaporized gas, having an air filter assembled with the air inlet for filtering impurities in the air. The air filter is positioned in a closed space of the engine with inferior ventilation; therefore air sucked into the engine through the air filter is limited and the air filter is likely to suck in hot air produced in the engine, disadvantageous to the engine. To improve this defect, an engine has been made with its air inlet connected with an air intake pipe which has its front end connected with an air filter so as to suck in a comparatively large quantity of cool air to help the engine to operate and prevent the air filter from sucking in hot air from the engine.

A conventional air intake pipe 10, as shown in FIG. 1, includes a pipe body 11 having one end formed with a large pipe and the other end formed with a small pipe. The large pipe and the small pipe of the pipe body 11 are respectively formed with a curved portion 12 with a pipe end 13. An air filter 20 is fitted on the large pipe end 13 so that air can be sucked into the pipe body 11 through the large pipe end 13 and exhausted through the small pipe end 13, able to increase the flowing speed of air.

However, the arrangement types of parts in the engine chamber of each automobile are different; therefore the conventional air intake pipe 10, which is designed in a single type, can only be assembled in a specific automobile, but cannot be freely adjusted to match with various engine rooms of different automobiles. Even though the conventional air intake pipe 10 can be assembled in a common automobile, the air filter 20 always cannot exactly face the front of the automobile, thus lowering effect of air intake.

SUMMARY OF THE INVENTION

A first objective of the invention is to offer an air intake pipe able to increase intake of air and bendable freely for assembly. The air intake pipe includes an accelerating inner fit pipe, an air intake outer pipe and a flexible fit pipe. The rotatable fit structure between the flexible fit pipe and the accelerating inner fit pipe and the air intake outer pipe, and the bendable and contractile flexible fit pipe enable the air intake pipe to be freely adjusted and installed in various engine rooms of different automobiles, having extensive applicability.

A second objective of the invention is to offer an air intake pipe able to increase intake of air and bendable freely for assembly. The connected portion between the air intake outer pipe and the accelerating inner pipe is gradually shrunk so as to increase the flow and the pressure of air sucked into an engine through the air intake pipe to heighten horsepower of the engine.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
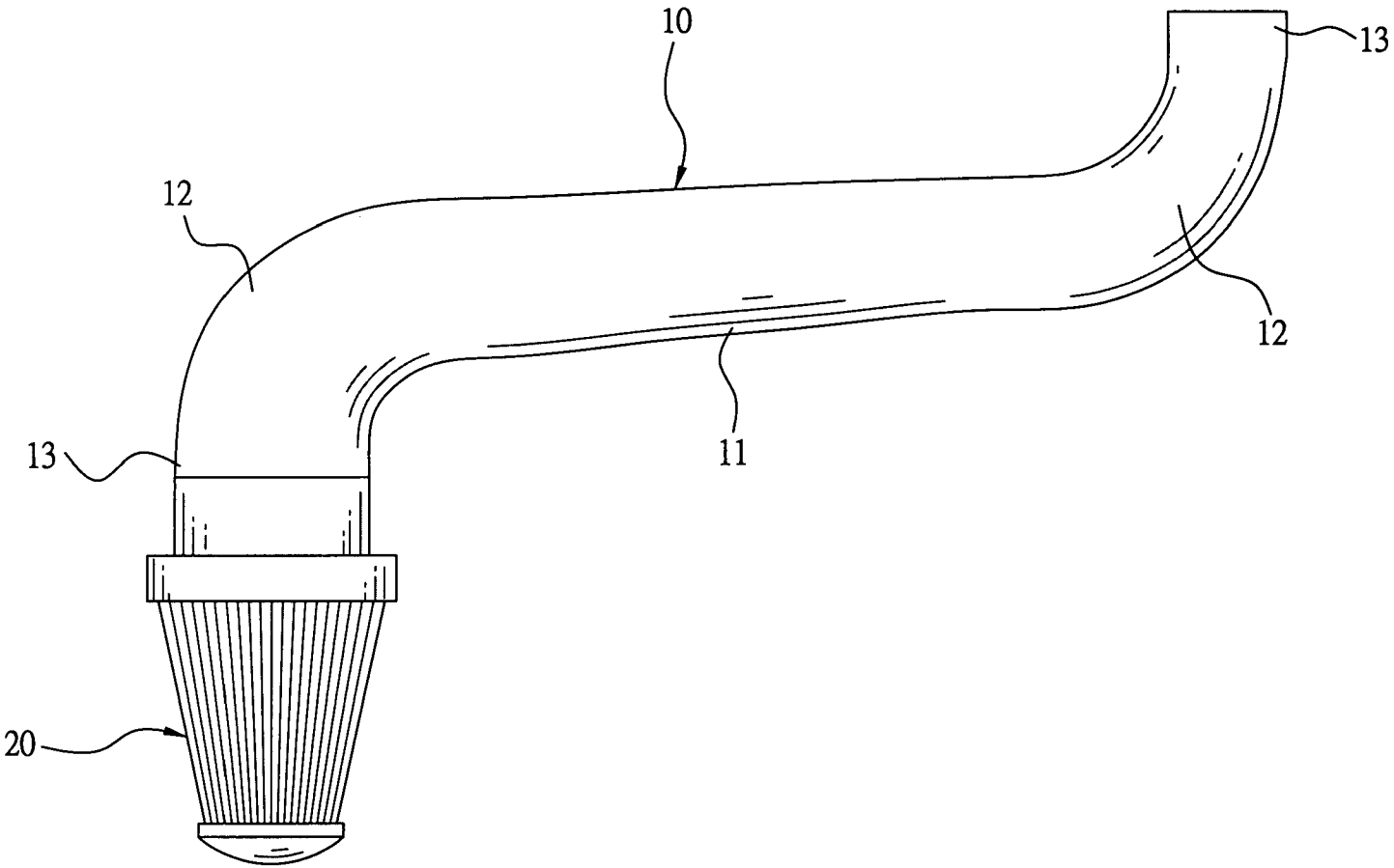
FIG. 1 PRIOR ART
FIG. 1 is a side-sectional view of a conventional air intake pipe.
Figure 2:
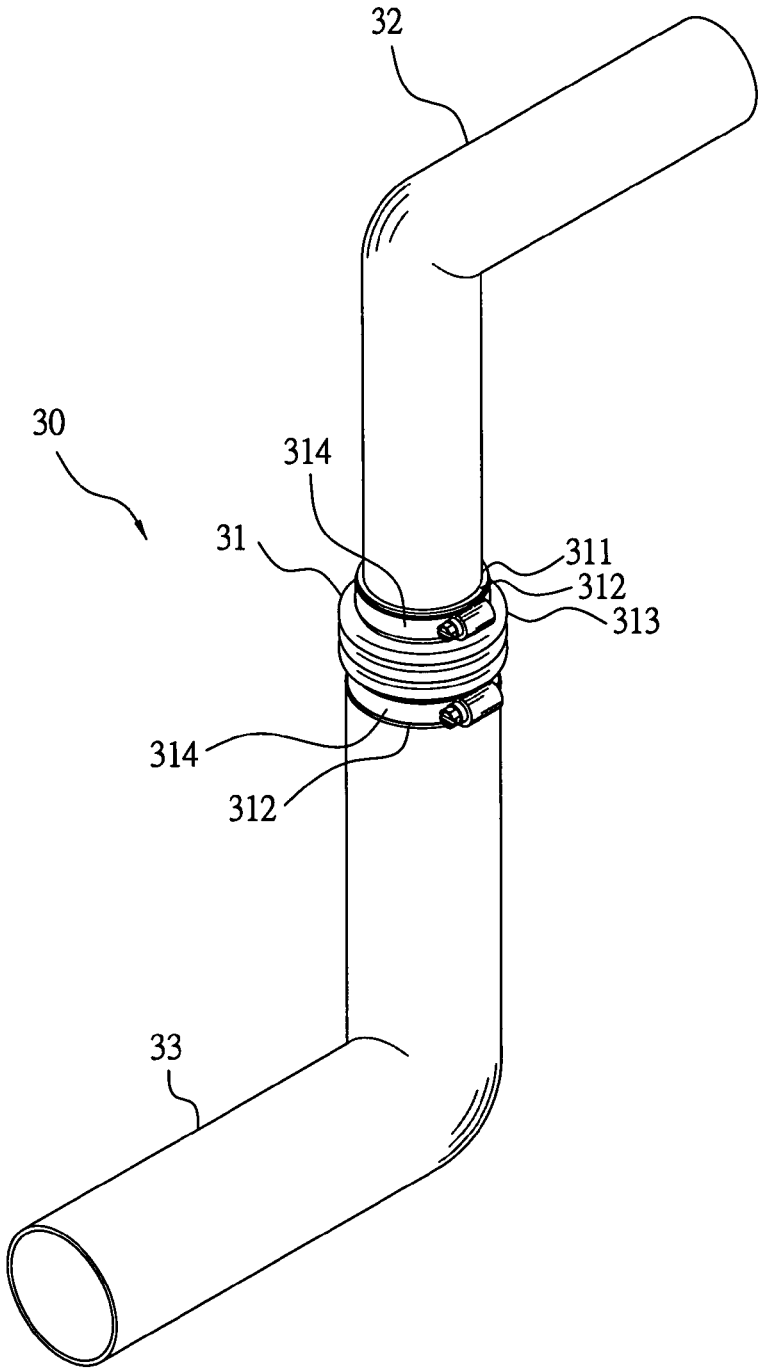
FIG. 2 is a perspective view of a first preferred embodiment of an air intake pipe in the present invention.
Figure 3:
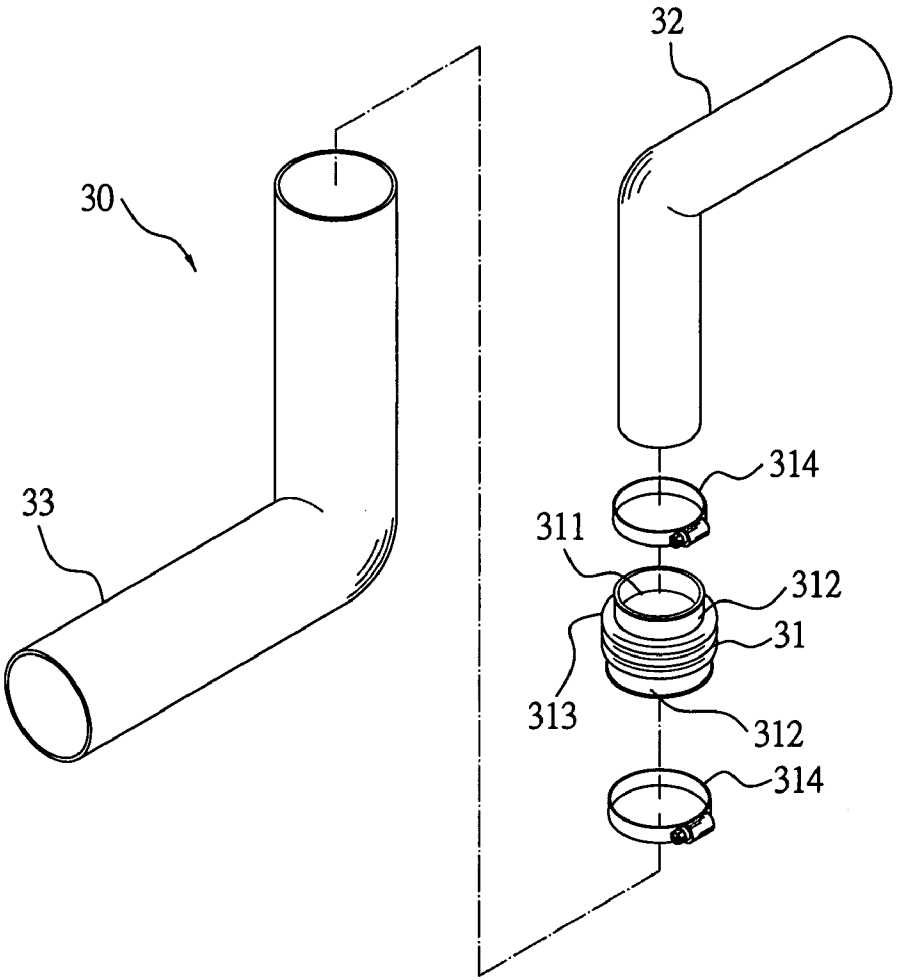
FIG. 3 is an exploded perspective view of the first preferred embodiment of the air intake pipe in the present invention.
Figure 4:
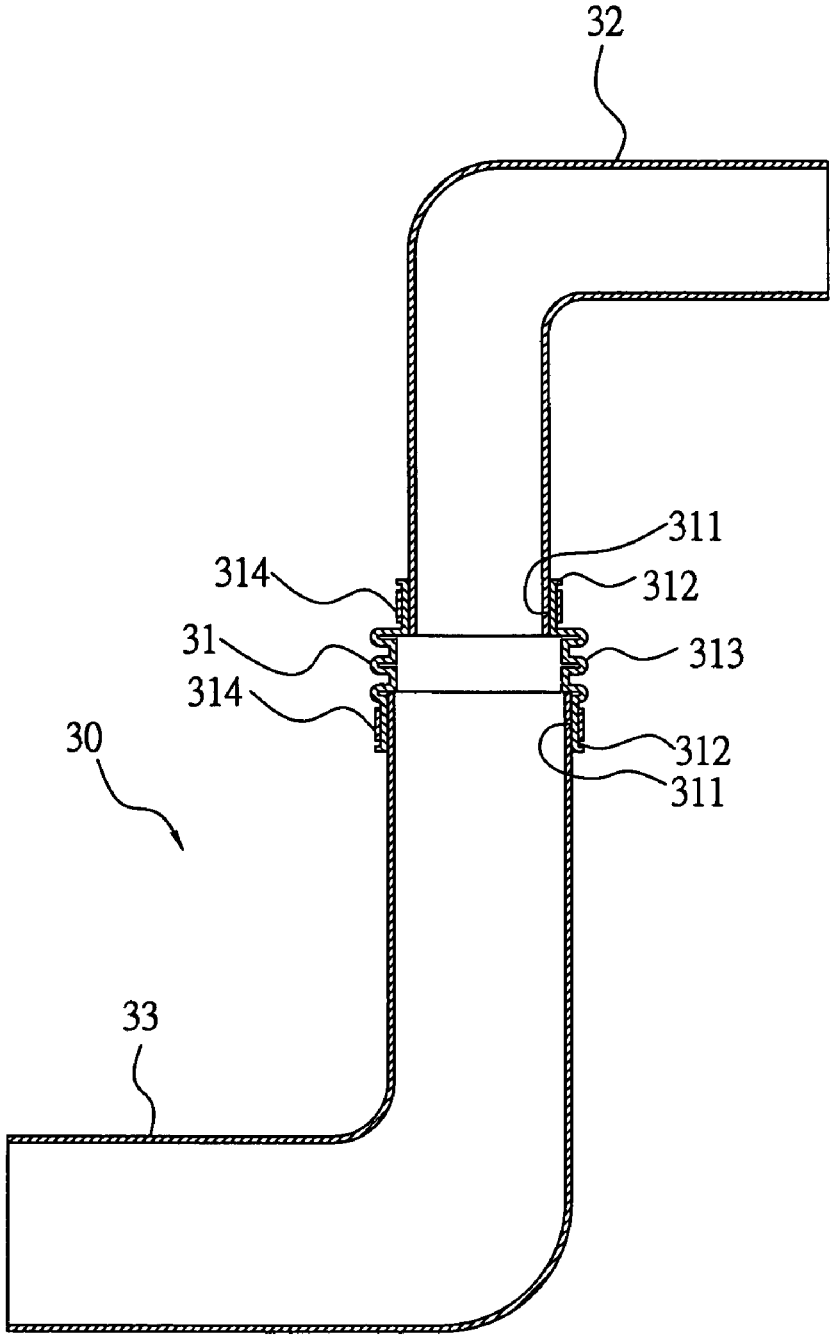
FIG. 4 is a cross-sectional view of the first preferred embodiment of the air intake pipe in the present invention.

A preferred embodiment of an air intake pipe able to increase intake of air and bendable freely for assembly in the present invention, as shown in FIGS. 2, 3 and 4, includes a flexible fit pipe 31, an accelerating inner pipe 32 and an air intake outer pipe 33.

The flexible fit pipe 31 made integral of rubber has its opposite openings respectively formed with a large and a small fit hollow 311 respectively having its outer circumferential edge shrunk inward and formed with a straight neck 312, and between these two necks 312 are formed a plurality of projecting rings 313 spaced apart at a preset distance. The flexible fit pipe 31 is flexible, and the projecting rings 313 are contractile and bendable so they can be bent in any direction and extended partially. The necks 312 can be respectively fitted thereon with a snap ring 314 of a preset size.

The accelerating inner pipe 32 bent for about 90 degrees has its lower end inserted in the small fit hollow 311 of the flexible fit pipe 31 and secured with the neck 312 by means of the snap ring 314.

The air intake outer pipe 33 bent for about 90 degrees and having a diameter a little larger than that of the accelerating inner pipe 32 has its upper end inserted in the large fit hollow 311 of the flexible fit pipe 31 and secured with the neck 312 by means of the snap ring 314.

Figure 5:
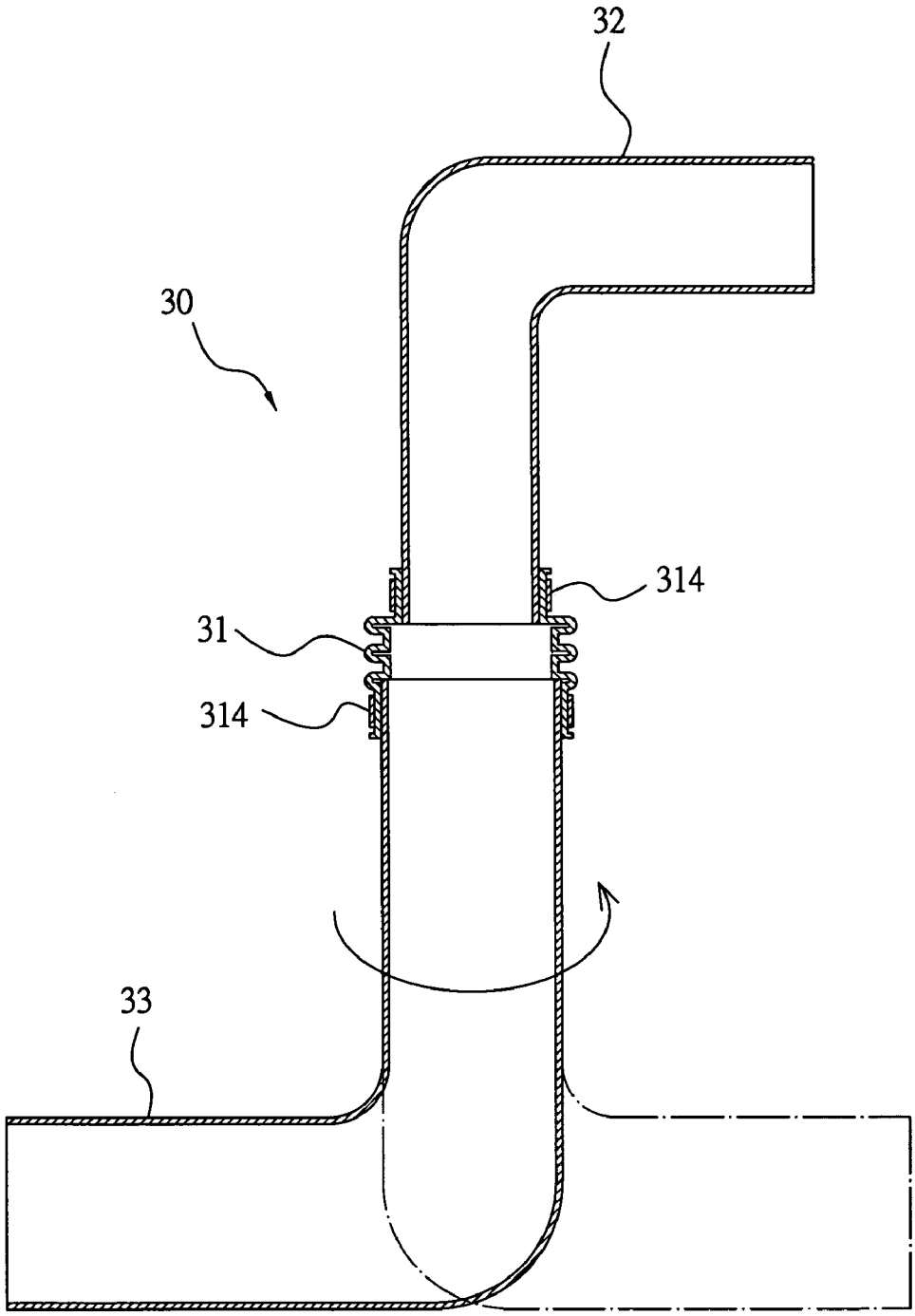
FIG. 5 is a cross-sectional view of the first preferred embodiment of the air intake pipe in a being-turned condition in the present invention.
Figure 6:
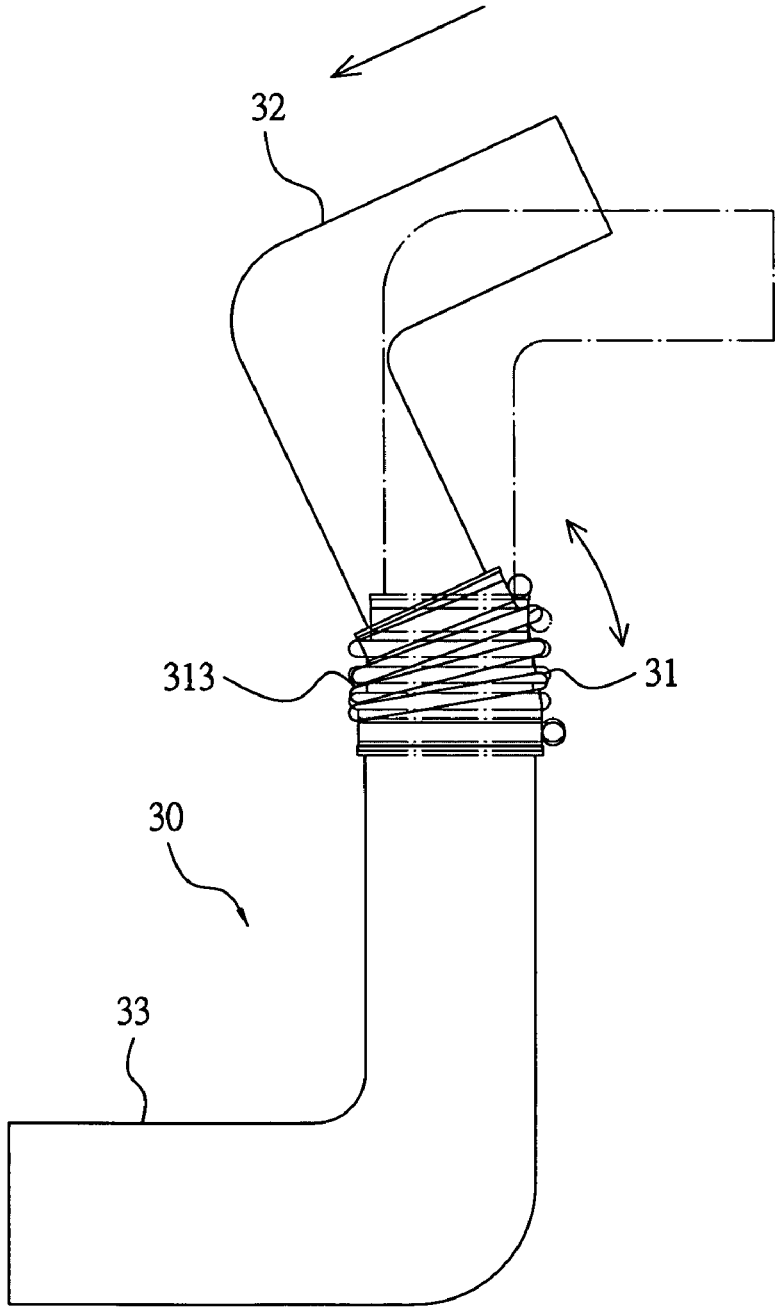
FIG. 6 is a cross-sectional view of the first preferred embodiment of the air intake pipe in a flexible and curved condition in the present invention.
Figure 7:
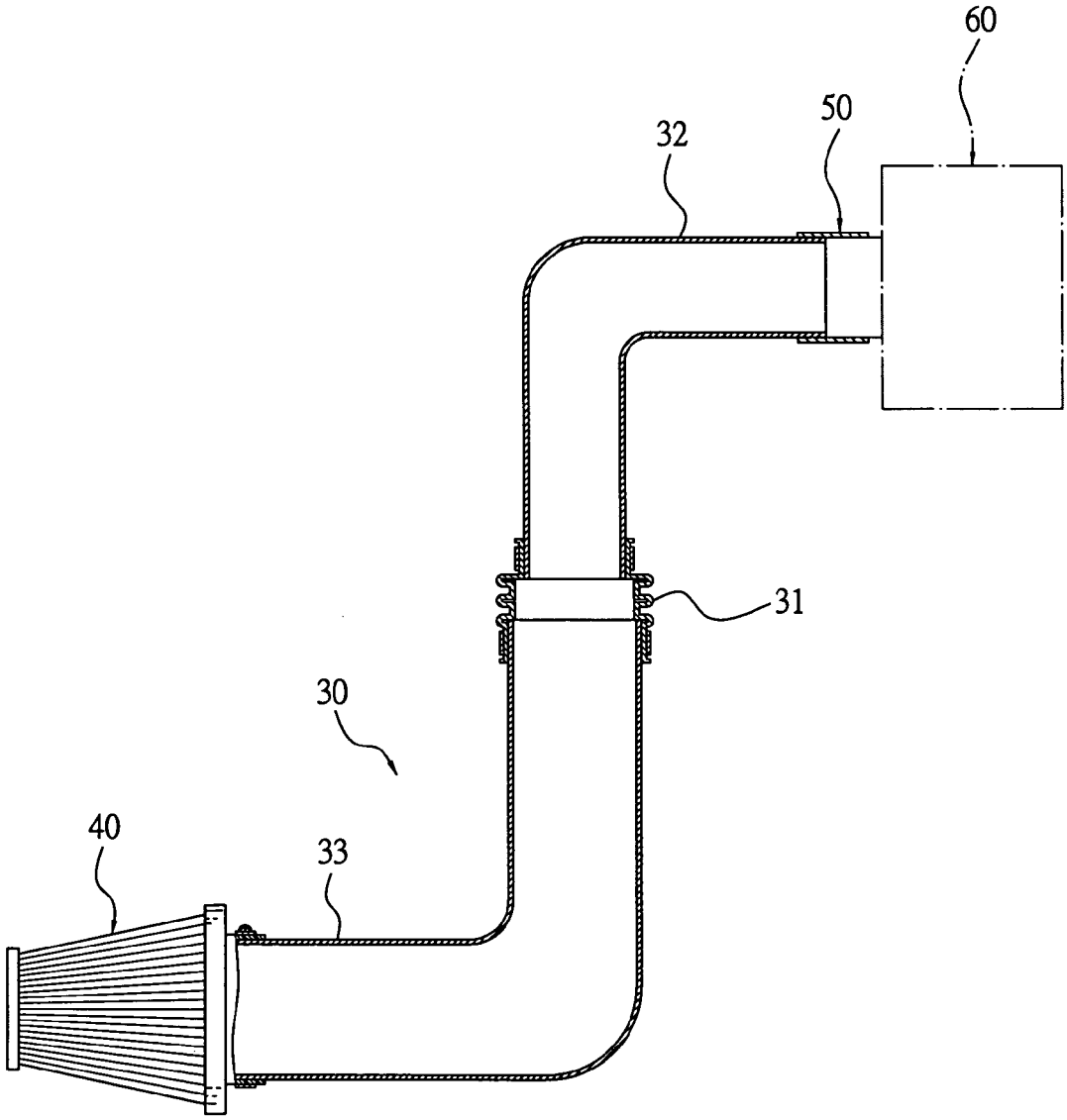
FIG. 7 is a cross-sectional view of the first preferred embodiment of the air intake pipe in an installed condition in the present invention.

In assembling, as shown in FIG. 7, the air intake outer pipe 33 of the air intake pipe 30 has its lower end connected with an air filter 40 and the accelerating inner pipe 32 has its upper end connected with the air intake end 60 of an engine by a hard connecting pipe 50, thus finishing assembly of the air intake pipe 30. Since the parts arrangement in the engine room of each automobile are different, therefore, the air intake pipe 30, before assembled, has to be adjusted so as to match with various inner spaces of the engines of different automobiles, and the air filter 40 on the air intake outer pipe 33 has to be adjusted to exactly face the front of an automobile. During assembling of the air intake pipe 30, the flexible fit pipe 31 between the accelerating inner pipe 32 and the air intake outer pipe 32 can be bent freely in any direction or extended partially to let the air intake pipe 30 installed in the engine room of an automobile conveniently, positioning the air filter 40 precisely, facilitating assembly and having extensive applicability, as shown in FIG. 5 and 6.

In addition, the air intake pipe 30 has its air intake outer pipe 33 for med with a diameter larger than that of its accelerating inner pipe 32, and the connected portion of these two pipes 33, 32 is shrunk by gradually. Therefore, when air is sucked into the accelerating inner pipe 32 through the air intake outer pipe 33, the pressure and flow of the air will increase, and the quantity and pressure of the air introduced into the engine room through the air intake end 60 will increase as well, able to elevate the operation horsepower of the engine.

Figure 8:
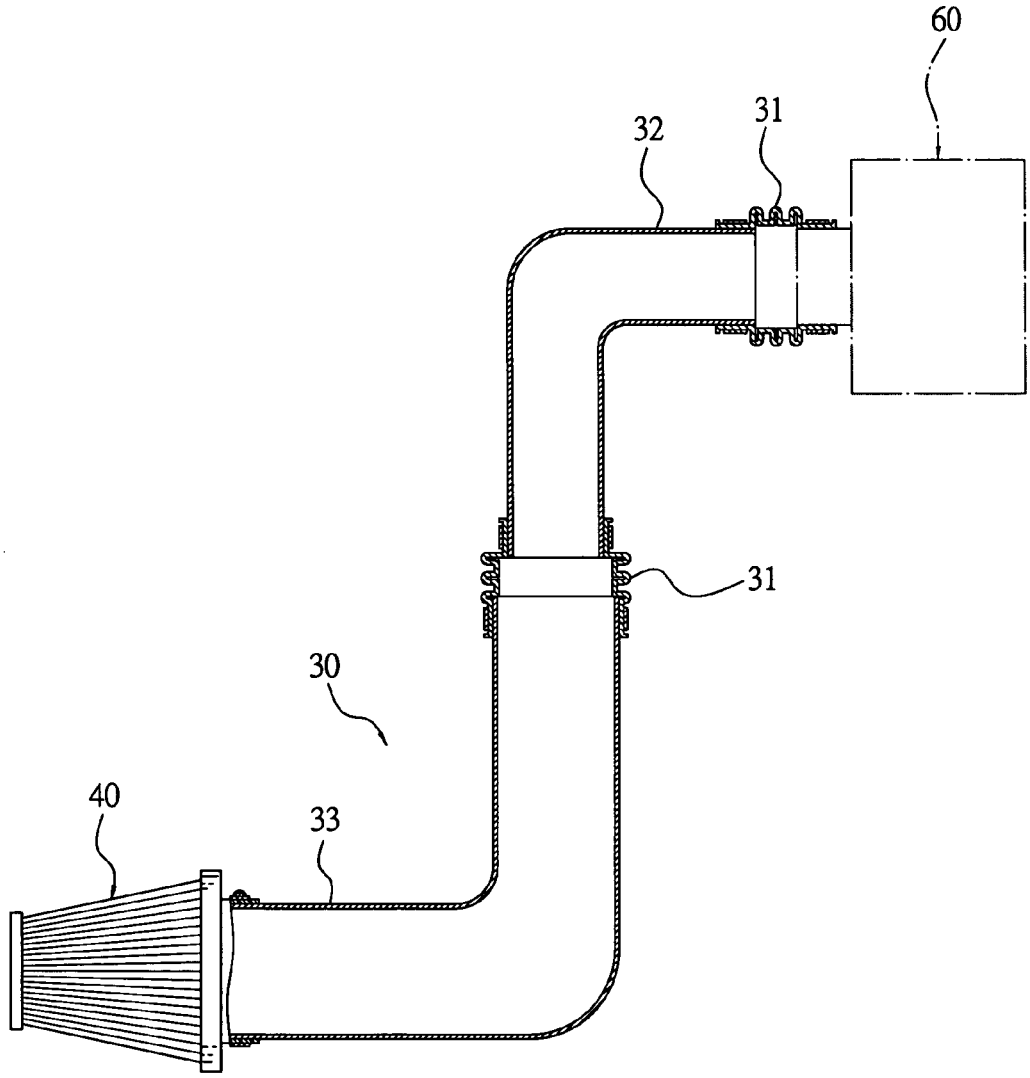
FIG. 8 is a cross-sectional view of a second preferred embodiment of the air intake pipe in installed condition in the present invention.

A second preferred embodiment of an air intake pipe 30 able to increase intake of air and bendable freely for assembly in the present invention, as shown in FIG. 8, includes a flexible fit pipe 31, an accelerating inner pipe 32 and an air intake outer pipe 33, which are all the same as described in the first preferred embodiment, and a second flexible fit pipe 31. The second flexible fit pipe 31 is fitted on the top end of the accelerating inner pipe 32, which is to be connected with the air intake end 60 of the engine room, and the opposite fitting hollows 311 of the second flexible fit pipe 31 respectively formed with a same-sized diameter. Thus, the second flexible fit pipe 31 enables the air intake pipe 30 to be assembled with various types of engine rooms of different automobiles.

While the preferred embodiments of the invention have been described above, it will be recognized and understood that various modifications may be made therein and the appended claims are intended to cover all such modifications that may fall within the spirit and scope of the invention.

I claim:

1. An air intake pipe able to increase intake of air and bendable freely for assembly, said air intake pipe comprising:

a flexible fit pipe having opposing ends respectively formed with a large and a small fit hollow, said large and small fit hollow communicating with each other, said large and said small fit hollow respectively having an outer circumferential edge shrunk inward and then extending upward to form a straight neck, between said two straight necks is formed a plurality of projecting rings spaced apart at a present distance, said flexible fit pipe having flexibility and contractility and able to be bent freely;

an accelerating inner pipe having a lower end inserted and secured in said small fit hollow of said flexible fit pipe, said accelerating inner pipe and said flexible fit pipe rotatable reciprocally for adjustment, said accelerating inner pipe having an upper end connected with the air intake end of an engine; and an air intake outer pipe having a diameter larger than that of said accelerating inner pipe, said air intake outer pipe having an upper end inserted and secured in said large fit hollow of said flexible fit pipe, said air intake outer pipe and said flexible fit pipe able to be reciprocally rotated for adjustment, wherein a second flexible fit pipe is fitted between the top end of said accelerating inner pipe and the air intake end of an engine.

2. The air intake pipe able to increase intake of air and bendable freely for assembly as claimed in claim 1, wherein said neck formed at the opposite ends of said flexible fit pipe is fitted thereon with a snap ring to tighten the end of said accelerating inner pipe and said air intake outer pipe, which is fitted in said neck, said snap ring able to be tightened and loosened so as to rotate and adjust said flexible fit pipe and said accelerating inner pipe and said air intake outer pipe.

3. The air intake pipe able to increase intake of air and bendable freely for assembly as claimed in claim 1, wherein said flexible fit pipe is made integral of rubber.

4. The air intake pipe able to increase intake of air and bendable freely for assembly as claimed in claim 1, wherein said air intake outer pipe has a lower end connected with an air filter.

* * * * *